US007980723B2

(12) United States Patent
Kosters

(10) Patent No.: US 7,980,723 B2
(45) Date of Patent: Jul. 19, 2011

(54) LUMINAIRE

(75) Inventor: Paulus G. H. Kosters, Delden (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 373 days.

(21) Appl. No.: 12/294,826

(22) PCT Filed: Mar. 21, 2007

(86) PCT No.: PCT/IB2007/050987
§ 371 (c)(1),
(2), (4) Date: Sep. 26, 2008

(87) PCT Pub. No.: WO2007/113717
PCT Pub. Date: Oct. 11, 2007

(65) Prior Publication Data

US 2010/0296277 A1 Nov. 25, 2010

(30) Foreign Application Priority Data

Mar. 30, 2006 (EP) ..... 06112000

(51) Int. Cl.
*F21V 7/04* (2006.01)

(52) U.S. Cl. ..... 362/217.07; 362/225; 362/231; 362/342; 362/217.03; 362/346

(58) Field of Classification Search ..... 362/225, 362/217.03, 217.04, 217.05, 217.07, 290, 362/235, 147, 297, 301, 303, 346, 231, 342
See application file for complete search history.

(56) References Cited

U.S. PATENT DOCUMENTS

| | | | | |
|---|---|---|---|---|
| 2,240,179 | A | 4/1941 | Doane | |
| 3,591,798 | A | 7/1971 | Florence | |
| 4,975,812 | A | 12/1990 | Cole, Jr. | |
| 6,616,307 | B2 * | 9/2003 | Haenen et al. | 362/341 |

FOREIGN PATENT DOCUMENTS

| | | | |
|---|---|---|---|
| EP | 1586811 | A1 | 10/2005 |
| JP | 54075879 | A | 6/1979 |
| JP | 11134910 | A | 5/1999 |
| WO | 0216827 | A1 | 2/2002 |

* cited by examiner

*Primary Examiner* — Thomas M Sember
(74) *Attorney, Agent, or Firm* — John F. Salazar; Mark L. Beloborodov

(57) ABSTRACT

The elongate luminaire for creating colored illumination has a plane of symmetry S in which lamp holders (6,7) are present to accommodate lamps of different colors. A first and a second opposite concave reflector (1,2) have elongate flat facets (11,12,13,14; 21,22,23,24). A third reflector (5) bridging the first and the second reflector (1,2) is present opposite a light-emission window (4). The luminaire is capable of providing evenly colored illumination without the need for a diffuser.

8 Claims, 4 Drawing Sheets

LUMINAIRE

This application is a national stage application under 35 U.S.C. §371 of International Application No. PCT/IB2007/050987 filed on Mar. 21, 2007 and published in the English language on Oct. 11, 2007 as International Publication No. WO2007/113717, which claims priority to European Application No. 06112000.2, filed on Mar. 30, 2006, incorporated herein by reference.

The invention relates to a luminaire, comprising:

a plane of symmetry S;

a first and a second concave, elongate reflector having a rim on both sides of the plane of symmetry S;

a light-emission window between the rims of the reflectors;

a third elongate reflector opposite the light-emission window, bridging a distance between the first and the second reflector; and a first and a second lamp holder, each having a center in the plane of symmetry S for accommodating a first elongate electric lamp for emitting light of a first spectrum and defining a first lamp axis and for accommodating a second elongate electric lamp for emitting light of a second spectrum and defining a second lamp axis, the center being situated on the first and the second lamp axis, respectively, a point M being located in the middle between the centers of the lamp holders, and the first lamp holder being further remote from the light-emission window than the second lamp holder.

An embodiment of such a luminaire is known from EP-A-1 586 811.

The known luminaire has smoothly curved first and second reflectors, which are bridged by a third, curved concave reflector. A diffuser is present, which, together with the third reflector, encloses the lamp holders and the lamps mounted therein. A fourth reflector is positioned between the diffuser and the adjacent lamp, mounted at a distance from the diffuser.

The object of using the fourth reflector is to intercept light from the lamp mounted closest to the diffuser, so as to prevent that the light from this lamp locally dominates to a strong extent. The light intercepted is largely reflected back to the lamp, which causes loss of light. The object of using the third reflector is to reflect light to the diffuser, mixing the light from the two lamps. Further mixing must be achieved by the diffuser, before the light emanating from the diffuser is shaped to a kind of beam by the first and the second reflector. The diffuser acts as a secondary light source. As the diffuser is very large as compared to the lamps, but also to the first and second reflectors, these reflectors are unable to shape the light emanating from the diffuser to a beam. Moreover, the multiple reflections in the inner portion of the luminaire and the presence of the diffuser cause loss of light.

Luminaires having lamps of a different spectrum can be used to illuminate offices, in which the emitted color is regulated in dependence on the users' wishes, or to illuminate shops, in which the color is chosen in dependence on the assortment of products presented e.g. on shelves. The term "color" herein also encompasses color temperature, e.g. warm and cold white, e.g. in the range from 3000K to 5000K.

It is a disadvantage of the known luminaire that it has a complicated, expensive structure.

It is an object of the invention to provide a luminaire of the type described in the opening paragraph, which has a simple and low-cost structure.

This object is achieved by a luminaire as defined in claim 1.

It was found that, for evenly mixing light of the first and the second lamp, light consuming multiple reflections and a lightabsorbing and expensive diffuser could be dispensed with. Together with the third reflector, the kinked reflectors are able to achieve the desired result. The luminaire of the invention is therefore not only simple and inexpensive, but also has the advantage that it is efficient because light absorption is counteracted and the light generated by the lamps is shaped to a beam and thereby directed and spread. The light thus generated is eminently suitable for homogeneous (colored) illumination of floors. Due to the beam-shaping and the avoidance of absorption, fewer luminaires are needed to illuminate a room. This also renders the luminaire inexpensive. Practice proved that a number of facets of each first and second reflector ranging from two to eight achieved the desired light-mixing, beam-shaping and efficacy.

A flat third reflector simplifies manufacture of the luminaire.

In one embodiment, the luminaire is defined by the features of claim 3. The angle δ is in the range from 25° to 50°, i.e. when δ is smaller than 25°, the first facet cannot be positioned well enough to contribute to the creation of evenly colored illumination. When δ is larger than 50°, the luminaire becomes too bulky for practical purposes. Generally, δ is chosen to be in the range from 30° to 45°. Mounted against, in or below a ceiling, the luminaire may be used for illuminating e.g. offices and shops. In particular, the embodiment defined in claim 3 is suitable for homogeneous illumination of a set of shelves mounted in a shop and ranging in height from e.g. 0.5 to 2.0 meters, while the luminaire is mounted e.g. at a height of about 2.75 m parallel to the center line of a path between opposite sets of shelves.

The flat third reflector may be e.g. a white-lacquered wall of a housing of the luminaire, but a metal or a metal-coated third reflector is preferably present because of the higher rate of mirroring reflections.

The first, second and third reflectors may be integral, i.e. they may form one part. This simplifies their mutual positioning and prevents possible slits between these reflectors through which light might escape and get lost. They may be specularly or semi-specularly reflecting, and may be made of metal, e.g. aluminum.

In a further embodiment, the first and the second reflectors each have fourth facets. The fourth facet extends at a smaller angle to the plane of symmetry than the third facet. This embodiment has the advantage that there is more prominent light emission in directions at a relatively large angle to the plane of symmetry, i.e. when the luminaire is mounted to a ceiling, with respect to areas located at a higher level.

To further improve the characteristics of the light beam emitted by the luminaire, it is provided with a plurality of lamellae in or adjacent the light-emission window.

The lamellae may be made of metal or of a metallized artificial resin, such as e.g. polycarbonate. The lamellae may be mutually united to form a lamellae louver.

Mounted against, in or below a ceiling, the luminaire may be used for illuminating e.g. offices and shops.

The luminaire can be mounted, for instance, in shops at a height of e.g. about 3 to 3.5 m parallel to the center line of a path between opposite sets of shelves.

Embodiments of the luminaire according to the invention are shown in and explained with reference to the drawings.

In these drawings.

Figure 1:
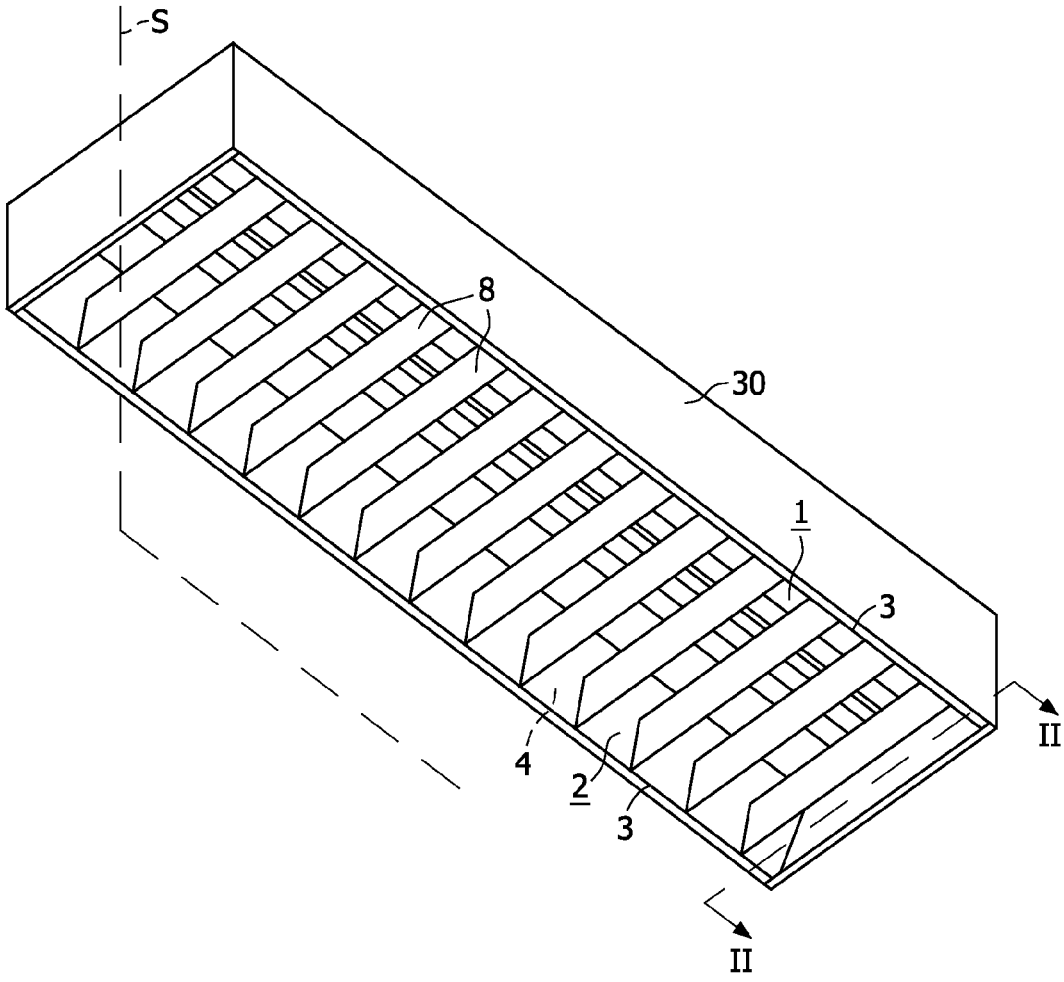
FIG. 1 is a perspective view of a first embodiment.
Figure 2:
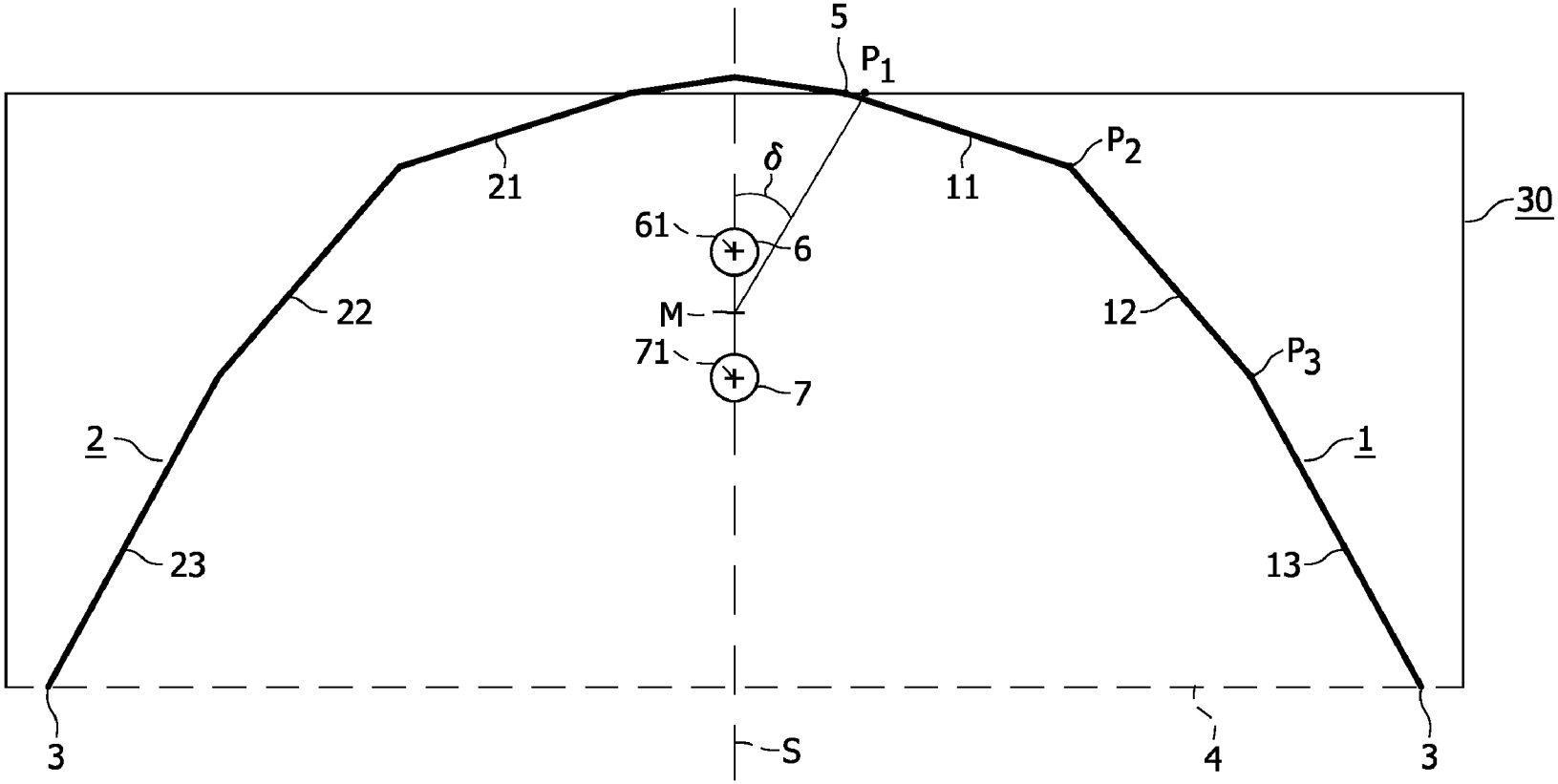
FIG. 2 is a cross-section taken on the line II-II in FIG. 1.

In FIGS. 1 and 2, the luminaire, which is suitable for creating colored illumination, has a housing 30 and a plane of symmetry S. A first and a second concave, elongate reflector 1,2 of aluminum, both having a straight rim 3, are present on both sides of the plane of symmetry S, see FIG. 1. A light-emission window 4 extends between the rims 3 of the reflectors 1,2. The luminaire has a third elongate reflector 5 opposite the light-emission window 4, which bridges a distance between the first and the second reflector 1,2. A first and a second lamp holder 6,7 each having a center 61,71 are located in the plane of symmetry S for accommodating a first elongate electric lamp for emitting light of a first spectrum and defining a first lamp axis and for accommodating a second elongate electric lamp for emitting light of a second spectrum and defining a second lamp axis. Electric fluorescent lamps may be used. The first and the second lamp axis of the lamps accommodated in said lamp holders 6,7 coincide with a center 61,71, respectively, of the lamp holders 6,7. A point M is located in the middle between the centers 61,71 of the lamp holders 6,7. The first lamp holder 6 is further remote from the light-emission window 4 than the second lamp holder 7. It is recommendable to mount a lamp of the highest color temperature or of the shortest peak wavelength in lamp holder 6. Such a lamp has a higher efficacy than a lamp of a lower color temperature or a longer peak wavelength. Mounted in lamp holder 6, it benefits most from the reflectors. As a result, the luminaire has its highest efficacy. A plurality of lamellae 8, see FIG. 1, is present adjacent the light-emission window 4. The lamp holders 6,7 accommodate the first and the second lamp between the first and the second reflector 1,2. The third reflector 5 is slightly kinked. In FIGS. 1 and 2, the third reflector 5 is a wall of the housing 30, which is white-lacquered. The first and the second reflector 1,2 are composed of flat elongate facets 11,12,13; 21,22,23 which extend along the plane of symmetry S.

FIG. 2 will be further explained with reference to FIG. 3.

Figure 3:
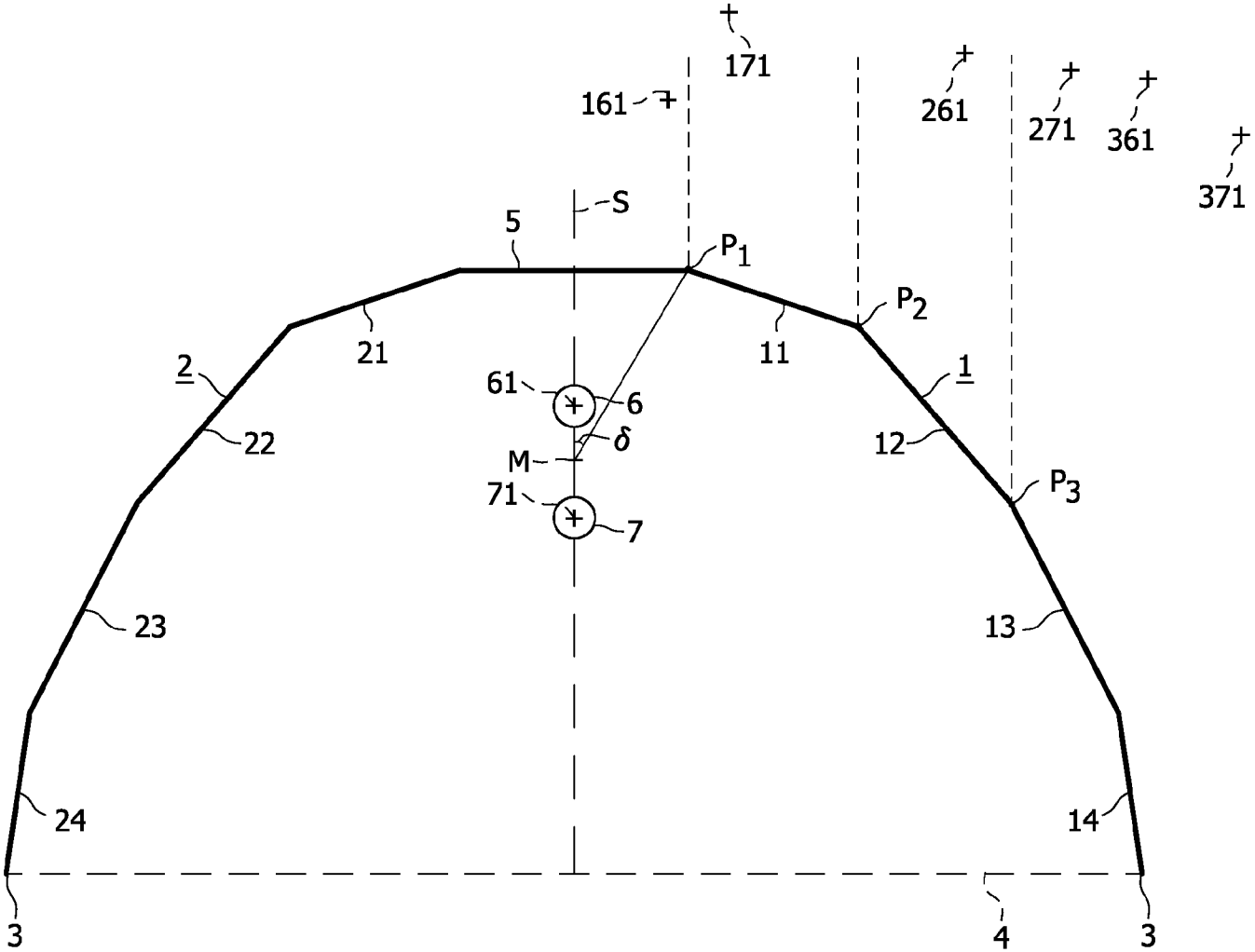
FIG. 3 is a similar cross-section through another embodiment.

In FIGS. 2 and 3, a first facet 11,21 extends from a point $P_1$ towards the light-emission window 4. Point $P_1$ is located adjacent the plane of symmetry S and in a cross-section through the lamp holders 6,7. A line $MP_1$ extends at an angle δ to the plane of symmetry S. The angle δ is in the range from 25° to 50°. In FIGS. 2 and 3, angle δ is 30° and 40°, respectively. The first facet 11,21 is directed so as to have a mirror image 161 of the center 61 of the first lamp holder 6 with a distance to the plane of symmetry S that is smaller than the distance from point $P_1$ to the plane of symmetry S. In this Figure, the reference numeral 171 denotes the mirror image in facet 1 of the center 71 of the second lamp holder 7. Dashed lines are drawn outside the reflector 1, parallel to the plane of symmetry, to indicate the distances from points $P_1$, $P_2$ and $P_3$ to this plane. These dashed lines support the statements with respect to the distances of the mirror images of the centers 61 and 71 of the lamp holders 6 and 7, respectively. A second facet 12,22 adjoins the first facet 11,21 at a point $P_2$. The second facet 12,22 is directed so as to have a mirror image 261 of the center 61 of the first lamp holder 6 and a mirror image 271 of the center 71 of the second lamp holder 7. The distance from both mirror images 261, 271 to the plane of symmetry S is larger than the distance from point $P_2$ to the plane of symmetry S. A third facet 13,23 adjoins the second facet 12,22 at a point $P_3$. This point $P_3$ has a distance to the plane of symmetry S that is in between the distances of the mirror images 261,271 of the center 61 of the first lamp holder 6 and of the center 71 of the second lamp holder 71 in the second facet 22. The third facet 23 is directed so as to have mirror images 361,371 of the center 61 of the first lamp holder 6 and of the center 71 of the second lamp holder 7. Both mirror images 361,371 have a distance to the plane of symmetry S which is larger than the distance from point $P_3$ to the plane of symmetry S.

In FIG. 3, the first 1, the second 2 and the third reflector 3 are integral. In FIG. 3, the first 1 and the second reflector 2 have a fourth facet 14,24 which extends at a smaller angle to the plane of symmetry S than the third facet 13,23. FIGS. 2 and 3 show that, whether or not after reflection at the first 1 or the second 2 and/or the third reflector 3, the light in the luminaire of the invention, generated by lamps accommodated in the lamp holders 6,7, directly has free access to the light-emission window 4 between every two adjacent lamellae 8, without having to pass a diffuser. The third reflector 5 is flat.

Figure 4:
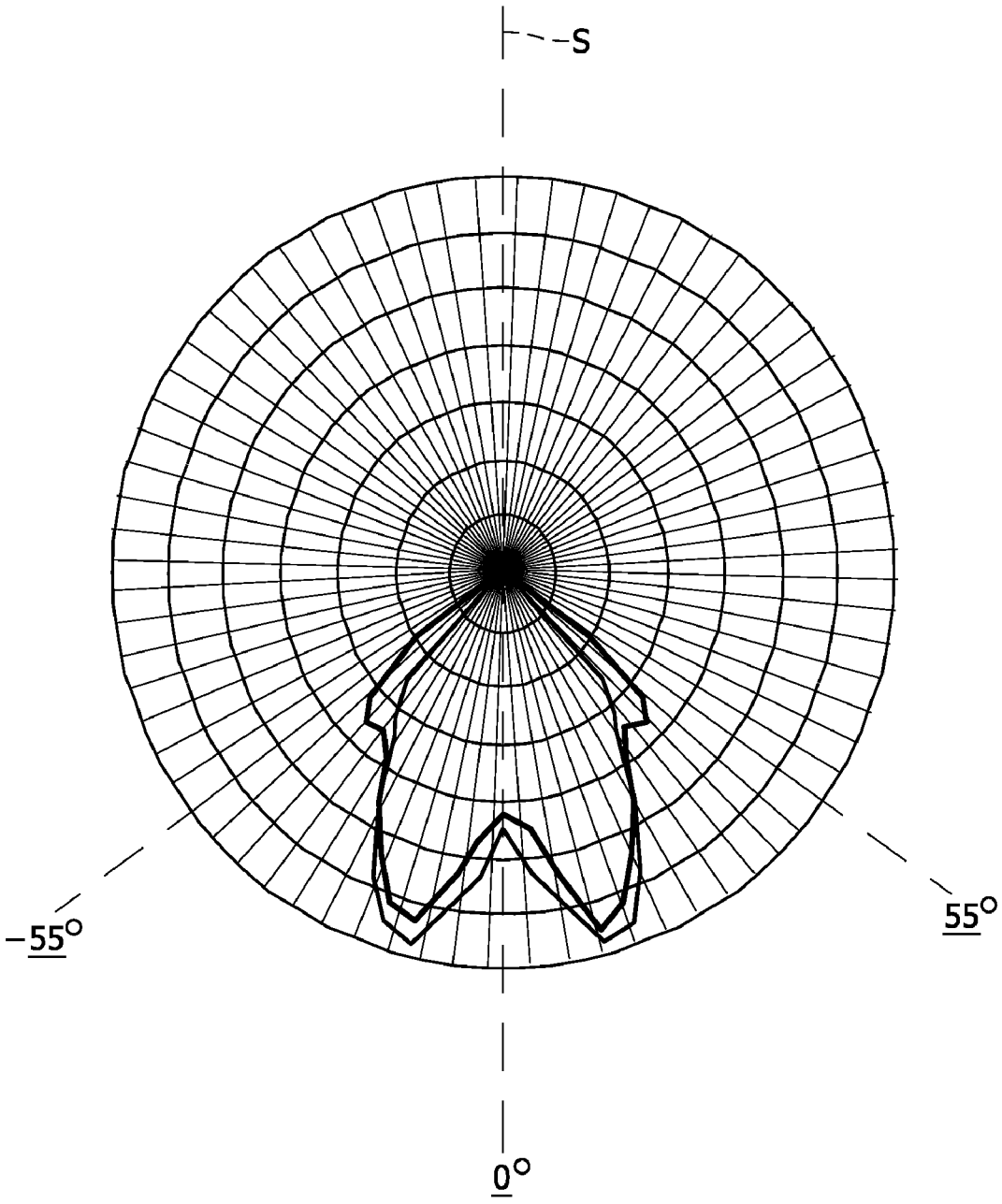
FIG. 4 shows a light distribution diagram of the embodiment of FIG. 3.

In FIG. 4, the distribution of light originating from the lamp in the first lamp holder 6 is represented by a thin line; the distribution of light originating from the lamp in the second lamp holder 7 is represented by a bold line. The two lines almost coincide. The actual differences in light distribution are so small that they are hardly observable or not observable by the human eye. The differences are largest around 0°, which is the floor of a path between opposite shelves, when the luminaire is mounted to the ceiling of a shop, and near the cut-off angle, which is about 55° in the embodiment shown. The last area is above the highest shelves. The Figure shows that the luminaire of the invention provides a simple and low-cost solution for creating illumination of a controllable color, which is energy-efficient and does not need an expensive diffuser.

The invention claimed is:

1. A luminaire having a plane of symmetry S, the luminaire comprising:

a first and a second concave reflectors oppositely disposed in relation to the plane of symmetry S and having outer rims, the reflectors comprising substantially flat elongate facets extending along the plane of symmetry S;

a light-emission window disposed between the outer rims of the reflectors;

a third reflector disposed opposite the light-emission window between the first and the second reflector; and a first and a second lamp holder, each having a center in the plane of symmetry S, for accommodating, between the reflectors, a first elongate electric lamp for emitting light of a first spectrum and defining a first lamp axis and a second elongate electric lamp for emitting light of a second spectrum and defining a second lamp axis, the centers being situated on the first and the second lamp axis, respectively, the first lamp holder being further remote from the light-emission window than the second lamp holder; wherein each of the reflectors comprises:

(i) a first extending from a point $P_1$ towards the light-emission window, said point $P_1$ being located adjacent the plane of symmetry S in a cross-section through the lamp holders, wherein a line from the point $P_1$ to a point M located in the middle between the centers of the lamp holders extends at an angle δ to the plane of symmetry S, said angle δ ranging from 25° to 50°, said first facet being oriented so as to be capable of generating a mirror image of the center of the first lamp holder with a distance to the plane of symmetry S which is smaller than a distance from point $P_1$ to the plane of symmetry S, (ii) a second facet adjoining the first facet at a point $P_2$, said second facet being oriented so as to be capable of generating a mirror image of the center of the first lamp holder and a mirror image of the center of the second lamp holder, both with a distance to the plane of symmetry S which is larger than a distance from point $P_2$ to the plane of symmetry S, and (iii) a third facet adjoining the second facet at a point $P_3$, $P_3$ having a distance to the plane of symmetry S which is in between the distances of the mirror images of the center of the first lamp holder and of the center of the second lamp holder in the second facet, said third facet being oriented so as to be capable of generating mirror images of the center of the first lamp holder and of the center of the second lamp holder, both with a distance to the plane of symmetry S which is larger than a distance from point $P_3$ to the plane of symmetry S.

2. A luminaire as claimed in claim 1, wherein the third reflector is flat.

3. A luminaire as claimed in claim 1 wherein each of the reflectors further comprises a fourth facet which extends at a smaller angle to the plane of symmetry S than the third facet.

4. A luminaire as claimed in claim 1, further comprising a plurality of lamellae disposed adjacent to or in the light-emission window.

5. A luminaire as claimed in claim 4, wherein the light generated by lamps accommodated in the lamp holders, directly has free access to the light-emission window between every two adjacent lamellae, without having to pass a diffuser.

6. A luminaire as claimed in claim 1, wherein said facets are capable of generating mirror images and are mutually oriented in such a way that said mirror images are alternately ordered mirror images of the first and the second lamp, respectively, in a direction perpendicular to the plane of symmetry S.

7. A luminaire as claimed in claim 6, wherein said mirror images are alternately ordered mirror images of the first and the second lamp, respectively, in a direction perpendicular to both the plane of symmetry S and the light-emission window.

8. A luminaire as claimed in claim 1, wherein the first, the second, and the third reflectors are integral.

* * * * *